United States Patent [19]

Brookbank, III

[11] Patent Number: 4,621,689

[45] Date of Patent: Nov. 11, 1986

[54] CABLE SUSPENDED SUBMERGIBLE PUMPING SYSTEM WITH SAFETY VALVE

[75] Inventor: Earl B. Brookbank, III, Bartlesville, Okla.

[73] Assignee: TRW Inc., Cleveland, Ohio

[21] Appl. No.: 772,472

[22] Filed: Sep. 4, 1985

[51] Int. Cl.[4] ..... E21B 43/12

[52] U.S. Cl. ..... 166/106

[58] Field of Search ..... 166/106, 105, 68, 133, 166/188

[56] References Cited

U.S. PATENT DOCUMENTS

| | | | |
|---|---|---|---|
| 3,411,454 | 11/1968 | Arutunoff | 417/424 |
| 3,468,258 | 9/1969 | Arutunoff | 166/212 |
| 3,672,795 | 6/1972 | Arutunoff | 417/424 |
| 4,021,137 | 5/1977 | Zehren | 415/147 |
| 4,352,394 | 10/1982 | Zehren | 166/106 |
| 4,440,221 | 4/1984 | Taylor et al. | 166/106 |
| 4,529,035 | 7/1985 | Bayh, III | 166/106 |

OTHER PUBLICATIONS

Baker Packers Completion Systems Catalog, Baker Oil Tools Co., 1981, pp. 757 and 777, Product No. 818.05.

*Primary Examiner*—Stephen J. Novosad
*Assistant Examiner*—Hoang C. Dang
*Attorney, Agent, or Firm*—Shapiro and Shapiro

[57] ABSTRACT

A cable suspended pumping system has a conventional subsurface safety valve, close to the surface, controlled by a conventional safety valve operating line. The safety valve is located in a tube that provides a flow passage through a packer. The cable is divided into an upper section above the packer and a lower section below the packer. The tube is suspended from the upper section of the cable, and the lower section of the cable is suspended from the tube. A submergible pumping unit is suspended from the lower section of the cable. The pumping unit includes an electrically driven pump having a discharge head that cooperates with a seating shoe for supporting the pump and for dividing the well into an intake zone and a discharge zone. Opposite ends of the tube are perforated so that production fluid may pass through the packer via the tube. Electric current carrying portions of the cable sections above and below the packer are joined by a cable packer penetrator extending through the packer.

5 Claims, 3 Drawing Figures

CABLE SUSPENDED SUBMERGIBLE PUMPING SYSTEM WITH SAFETY VALVE

BACKGROUND OF THE INVENTION

This invention is concerned with cable suspended pumping systems and is more particularly concerned with the provision of safety apparatus in such systems.

In tubing suspended submergible pumping systems for oil wells it is conventional to provide a pack-off tubing hanger assembly that includes a wireline retrievable surface controlled safety valve, run 100 feet below the mud line, for example, to keep the well under control in the event of damage to the wellhead. A control line may be used to set the hanger in the well and to actuate the safety valve. In addition to the production fluid path controlled by the safety valve, the hanger-valve installation may include an annulus gas vent, a cable by-pass, and a fluid by-pass that allows opening and closing of the safety valve without shutting off the electric pump suspended from the pack-off tubing hanger.

The advantages of this type of construction have not heretofore been available in cable suspended pumping systems, i.e., systems in which the submergible pumping apparatus is suspended by a cable, rather than by tubing. An advantage of cable suspended pumping systems is that they can be run into or out of a well by cable winches, eliminating the need for long lengths of tubing in deep wells and eliminating the need for assembling and disassembling tubing sections during installation and removal of the pumping apparatus.

In the past, safety valves in cable suspended pumping systems have been part of the downhole pumping unit, usually thousands of feet beneath the earth's surface. Because of the inaccessibility of the safety valves in such systems, the valves are operated in response to pump discharge pressure. This requires a non-standard design and one that will not operate in all well conditions. To operate the valves properly in response to pump discharge pressure it is necessary that the pump build up pressure rapidly. This can be achieved when the well fluid is rather incompressible, but most wells contain significant amounts of natural gas dissolved in oil, or as free gas in the well. Under these circumstances the column of fluid above the pump is very compressible, and pump pressure builds up very slowly.

BRIEF DESCRIPTION OF THE INVENTION

The present invention provides cable suspended pumping systems with the advantages of standard subsurface safety valves commonly used in tubing suspended systems. These additional advantages are provided while maintaining the inherent advantages of cable suspended pumping systems. In one of its broader aspects, the invention comprises a downhole pumping unit including a submergible pump and an electric motor for driving the pump, cable means for suspending the pumping unit downhole and having one end provided with means for connection to the pumping unit and an opposite end provided with means for connection to a wellhead, said cable means including a weight-bearing portion and an electric current conducting portion, a pack-off assembly including a packer and a tube extending therethrough and sealed therein, said packer being adapted to divide a well into an upper region and a lower region, said tube having a perforated lower portion and a perforated upper portion, whereby pumped fluid may enter the tube at the lower region, pass through the packer via the tube, and exit the tube at the upper region, a subsurface safety valve in the tube having a safety valve operating line extending from the safety valve to the wellhead, whereby a flow passage through the tube may be opened and closed at will independent of the operation of the pump, and means for electrically connecting a section of the electrical conductor portion of the cable means that is above the packer to a section of the electrical conductor portion of the cable means that is below the packer, the section of the cable means that is above the packer being substantially shorter than the section that is below the packer so that the subsurface safety valve is readily accessible from the wellhead.

BRIEF DESCRIPTION OF THE DRAWINGS

The invention will be further described in conjunction with the accompanying drawing which illustrates preferred and exemplary (best mode) embodiments, and wherein.

DESCRIPTION OF THE PREFERRED EMBODIMENTS

Figure 1:
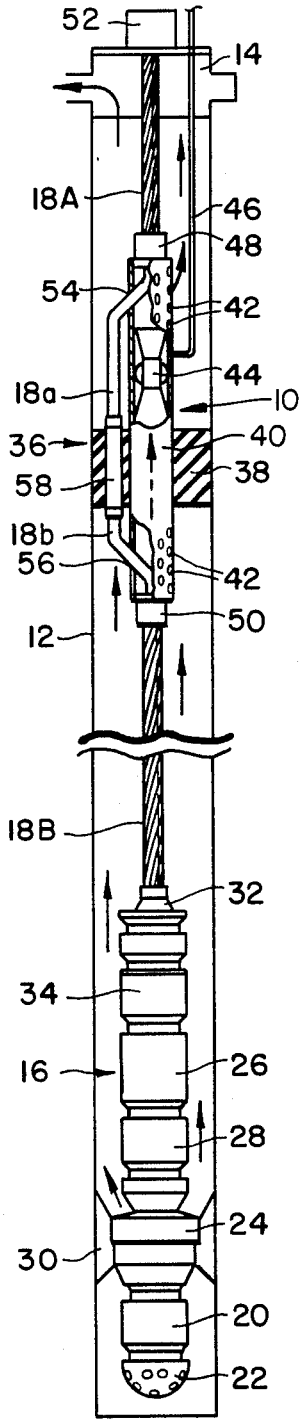
FIG. 1 is a somewhat diagrammatic vertical sectional view illustrating a system in accordance with the invention installed in a well.

Referring to the drawing, FIG. 1 shows a cable suspended pumping system 10 of the invention installed in a well having a casing or liner 12. The upper end of the casing or liner is connected to a wellhead 14 at the earth's surface, and the lower end is perforated in a conventional manner to admit fluid from oil-bearing strata, for example. A conventional downhole pumping unit 16 is suspended in the well by means of a cable comprising an upper section 18A and a lower section 18B. The pumping unit comprises a number of components arranged serially (dimensions being compressed and distorted in the drawing for ease of illustration), including a centrifugal submergible pump 20 having an intake 22 at the bottom of the pump and a discharge head 24 at the top of the pump, and an electric motor 26, which drives the pump by means of an axial shaft that extends from the motor to the pump through an intervening motor protector (pressure balancer) 28. The discharge head 24 is associated with a seating shoe 30 that supports the pump in the well and that divides the well into an intake zone below the shoe and a discharge zone above the shoe.

In the form of the invention shown in FIG. 1, the cable 18A, 18B is of the type that includes a weight-bearing portion and an electrical current carrying portion integrally contained within an outer armor. The bottom of cable section 18B is connected to a so-called rope socket 32 by which the pumping unit 16 is suspended from the weight-bearing portion of the cable. The electrical current carrying portion of the cable is extended through the rope socket to a connection chamber 34, where the electrical conductors of the cable are connected to corresponding lead-in conductors of motor 26.

In a conventional cable suspended pumping system the cable would extend continuously from the wellhead 14 to the rope socket 32. See, for example, the cable suspended systems in U.S. Pat. Nos. 3,411,454, issued Nov. 19, 1968; 3,468,258, issued Sept. 23, 1969; and 3,672,795, issued June 27, 1972, all assigned to the same assignee as the present invention. As is apparent in those patents, the electric motor (and related components) may be located above or below the pump, and either arrangement may be used in the present invention also.

As shown in U.S. Pat. Nos. 3,411,454 and 3,468,258, simple check valves may be employed as part of the downhole pumping unit, opening in response to pump discharge pressure and closing when the pump is not operating. More sophisticated safety valves have also been incorporated in the downhole pumping unit of cable suspended pumping systems, as shown, for example, in U.S. Pat. No. 4,021,137, issued May 3, 1977 and assigned to the assignee of the present invention. However, as stated earlier, the safety valves employed in cable suspended pumping systems have been nonstandard (specialized) safety valves that do not operate under all well conditions and that cannot be controlled at will from the surface (because of the impracticality of long control lines). Moreover, such safety valves are, in general, more complex and expensive than the standard safety valves emmployed in tubing suspended pumping systems.

In accordance with the present invention it has been possible, for the first time, to provide a standard subsurface safety valve, operated by a control line from the surface, in a cable suspended pumping system. This has been achieved simply, by dividing the cable into two sections, 18A and 18B, and by employing a pack-off assembly in conjunction with the cable sections. As shown in FIG. 1, the pack-off assembly 36 comprises a conventional packer 38 and a tube 40 that extends through and is sealed in the packer. The packer, which may be set in the well by appropriate conventional means, divides the well into an upper region and a lower region. The upper and lower end portions of the tube 40 are perforated as shown at 42, so that well fluid entering the intake 22 of the pump and discharged from the discharge head 24 may enter the perforated lower end portion of the tube 40 at the lower region, pass through the packer 38 via a flow passage in the tube, and exit to the upper region through the perforated upper end portion of the tube. The fluid then continues to flow upwardly to the wellhead 14 as indicated by the arrows in FIG. 1. Tube 40 has a conventional two-way subsurface safety valve 44 therein controlled from the surface by a safety valve operating line 46, either hydraulically or electrically. The safety valve, which controls the flow of fluid through tube 40 between the lower region and the upper region, may be a conventional type well known in the oil industry, for example Model BGL wireline retrievable safety valve, Product No. 818-05 shown and described on pp. 757 and 777 of the Baker Packers Completion Systems 1981 Catalog of Baker Oil Tools Company, incorporated herein by reference.

The upper end of tube 40 has a rope socket 48 by which the tube is suspended from the bottom of cable section 18A, and the lower end of tube 40 has a rope socket 50 connected to the top of cable section 18B, so the tube 40 serves to transmit the weight load of the pumping unit 16 and the cable section 18B to the cable section 18A, the upper end of which is supported at the wellhead and is packed off by a cable pack-off 52. The electrical current carrying conductor portions of the cable sections 18A and 18B are extended downwardly and upwardly therefrom, respectively, and pass through sideholes 54 and 56 of tube 40 to a packer penetrator 58. The penetrator includes a conventional sealed mandrel having conductors that are connected to the corresponding conductors of the cable sections 18A and 18B, so that a continuous electrical path is provided through the packer. Conventional seals (not shown) are provided at the rope sockets 48 and 50 in centrally bored end plates of tube 40 so that well fluid cannot enter the cable sections 18A and 18B above and below the rope sockets, respectively.

Cable section 18A is much shorter than cable section 18B (in most instances several orders of magnitude shorter). For example, cable section 18A may be 100 feet long, while cable section 18B may be 10,000 feet long. Thus the safety valve 44 is readily accessible from the earth's surface and is easily controlled in a conventional manner by the operating line 46. Nevertheless, all of the advantages of a conventional cable suspended pumping system are provided.

Figure 2:
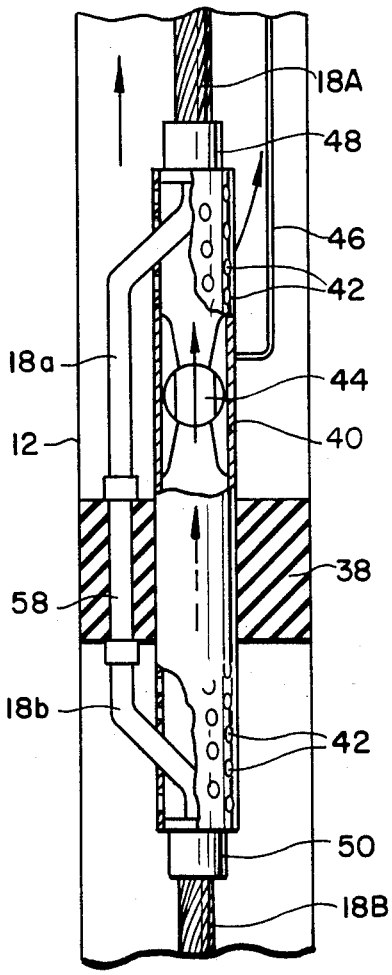
FIG. 2 is a similar view of a portion of the system of FIG. 1 shown enlarged.
Figure 3:
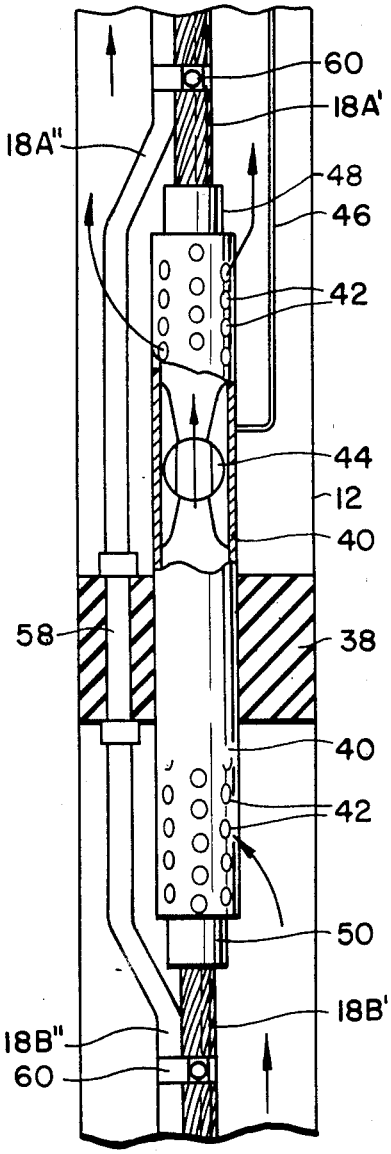
FIG. 3 is a view similar to FIG. 2, but illustrating a modification.

As shown in FIG. 3, instead of using an integral cable of the type shown in FIGS. 1 and 2, the cable may have separate weight-bearing portions 18A', 18B', and electrical current carrying portions 18A", 18B", which may be banded together, side-by-side, as indicated by the bands 60. In the system of FIG. 3, it is unnecessary to provide side openings in tube 40 or to provide cable seals at the end plates of tube 40 that are attached to rope sockets 48 and 50. The current carrying portions 18A" and 18B" are merely joined to the penetrator 58.

While preferred embodiments of the invention have been shown and described, it will be apparent to those skilled in the art that modifications can be made within the general principles of the invention. For example, the cable sections could be connected to opposite ends of a weight-bearing member that passes through and is sealed within the packer and that is separate from the tube 40 that contains the safety valve 44.

What is claimed is:

1. A cable suspended pumping system comprising a downhole pumping unit including a submergible pump and an electric motor for driving the pump, cable means for suspending the pumping unit downhole and having one end provided with means for connection to the pumping unit and an opposite end provided with means for connection to a wellhead, said cable means including a weight-bearing portion and an electric current conducting portion, a pack-off assembly including a packer and a tube extending therethrough and sealed therein, said packer being adapted to divide a well into an upper region and a lower region, said tube having a perforated lower portion and a perforated upper portion, whereby pumped fluid may enter the tube at the lower region, pass through the packer via the tube, and exit the tube at the upper region, a subsurface safety valve in the tube having a safety valve operating line extending from the safety valve to the wellhead, whereby a flow passage through the tube may be opened and closed at will independent of the operation of the pump, and means for electrically connecting a section of the electrical conductor portion of the cable means that is above the packer to a section of the electrical conductor portion of the cable means that is below the packer, the section of the cable means that is above the packer being substantially shorter than the section that is below the packer so that the subsurface saftey valve is readily accessible from the wellhead.

2. A cable suspended pumping system in accordance with claim 1, wherein the weight-bearing portion of the cable means is divided into an upper section and a lower section, and further comprising means for connecting to the upper end of the tube a lower end of the upper section of the weight-bearing portion of the cable means, in order to suspend the tube therefrom, and means for connecting to the lower end of the tube an upper end of the lower section of the weight-bearing portion of the cable means, so that the pumping assembly may be suspended from the tube.

3. A cable suspended pumping system in accordance with claim 2, wherein the weight-bearing portion and the electric current carrying portion of the cable means are integral parts of an armored cable, wherein said tube has a sidehole at each of said upper and lower end portions thereof, wherein a lower end of the upper section of the electrical current carrying conductor portion of the cable means and an upper end of the lower section of the electrical current carrying portion of the cable means extend through said holes, respectively, and wherein said joining means is a cable packer penetrator extending through the packer.

4. A cable suspended pumping system in accordance with claim 2, wherein the weight-bearing portion and the electrical current carrying portion of the cable means are arranged side-by-side and are strapped together, and wherein a lower end of the upper section of the electrical current carrying portion of the cable means and an upper end of the lower section of the electrical current carrying portion of the cable means are joined by a cable packer penetrator extending through the packer and constituting said joining means.

5. A cable suspended pumping system in accordance with claim 2, wherein the submergible pump has an intake at the bottom of the pump and a discharge head at the top of the pump, the discharge head having a seating shoe associated therewith for supporting the pump in a well and for providing separate intake and discharge zones below and above the seating shoe, respectively.

* * * * *